US011208848B1

(12) United States Patent
Wendt et al.

(10) Patent No.: US 11,208,848 B1
(45) Date of Patent: Dec. 28, 2021

(54) CUTTING ELEMENT FOR CASING BIT

(71) Applicant: Klear Bit Technologies LLC, Decatur, TX (US)

(72) Inventors: Jacob Wendt, Decatur, TX (US); Neal Bowden, Weatherford, TX (US)

(73) Assignee: Klear Bit Technologies LLC, Decatur, TX (US)

( * ) Notice: Subject to any disclaimer, the term of this patent is extended or adjusted under 35 U.S.C. 154(b) by 110 days.

(21) Appl. No.: 16/517,218

(22) Filed: Jul. 19, 2019

Related U.S. Application Data

(60) Provisional application No. 62/700,714, filed on Jul. 19, 2018.

(51) Int. Cl.
*E21B 10/43* (2006.01)
*E21B 29/00* (2006.01)
*E21B 10/567* (2006.01)

(52) U.S. Cl.
CPC ..... *E21B 10/43* (2013.01); *E21B 10/567* (2013.01); *E21B 29/00* (2013.01)

(58) Field of Classification Search
CPC ..... E21B 10/42; E21B 10/43; E21B 10/54; E21B 10/567; E21B 29/00
See application file for complete search history.

(56) References Cited

U.S. PATENT DOCUMENTS

| | | | | |
|---|---|---|---|---|
| 6,044,920 | A * | 4/2000 | Massa | E21B 10/567 175/417 |
| 6,119,797 | A | 9/2000 | Hong et al. | |
| 6,123,160 | A * | 9/2000 | Tibbitts | E21B 10/26 175/385 |
| 6,349,780 | B1 * | 2/2002 | Beuershausen | E21B 10/46 175/408 |
| 2004/0069531 | A1 * | 4/2004 | McCormick | E21B 17/1092 175/57 |
| 2006/0157286 | A1 * | 7/2006 | Pope | E21B 10/567 175/374 |
| 2007/0023206 | A1 * | 2/2007 | Keshavan | E21B 17/1092 175/374 |
| 2009/0032309 | A1 * | 2/2009 | Schwefe | E21B 17/1092 175/408 |
| 2013/0292186 | A1 | 11/2013 | Zhang et al. | |

FOREIGN PATENT DOCUMENTS

| | | |
|---|---|---|
| CN | 000201276987 Y | 7/2009 |
| CN | 000204186310 u | 3/2015 |

* cited by examiner

*Primary Examiner* — David Carroll
(74) *Attorney, Agent, or Firm* — James E. Walton

(57) ABSTRACT

A downhole tool, or earth-boring bit, for use in disintegrating structures in a cased wellbore includes a tool body having a central axis about which the tool body rotates and an outermost gage surface on the tool body. At least one gage cutting element on the gage surface has a blunt outermost projection and a sharp cutting edge recessed from the blunt outermost projection, wherein, during rotation of the tool body, the blunt outermost surface contacts the cased wellbore and the sharp cutting edge does not. The blunt outermost projection may be on a leading element while the sharp cutting edge is on a separate, trailing element.

19 Claims, 6 Drawing Sheets

CUTTING ELEMENT FOR CASING BIT

This application claims the benefit of U.S. Provisional Application No. 62/700,714, filed 19 Jul. 2018, titled "Improved Cutting Element for Casing Bit," which is incorporated herein for all purposes.

BACKGROUND

1. Field of the Invention

The present invention relates generally to improvements in bits and other tools for cased-hole operations.

2. Description of Related Art

Often in the course of drilling and producing a hydrocarbon well, it becomes necessary to conduct completions, recompletions, work-overs, or similar operations in a wellbore in which casing has been cemented (a cased hole or cased wellbore). Such operations may include removal of packers, bridge plugs, and other equipment from the cased hole. Such removal operations frequently require disintegrating or grinding-up such equipment by drilling through the component with a specially designed bit and removing the metallic and elastomeric cuttings from the wellbore.

In such operations, it is important to avoid damage to the existing casing. Accordingly, bits and other tools are designed to avoid or minimize cutting into the casing. Therefore, bits and tools for use in cased-hole operations often lack cutting elements at the gage or inner diameter of the casing. However, it is possible for a large cutting to become wedged between the outer diameter of the bit or another tool and the inner diameter of the casing, causing the bit or tool to become stuck. Thus, some degree of gage cutting is desirable.

A need exists, therefore, for improvements in tools for disintegrating structures in cased wellbores.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
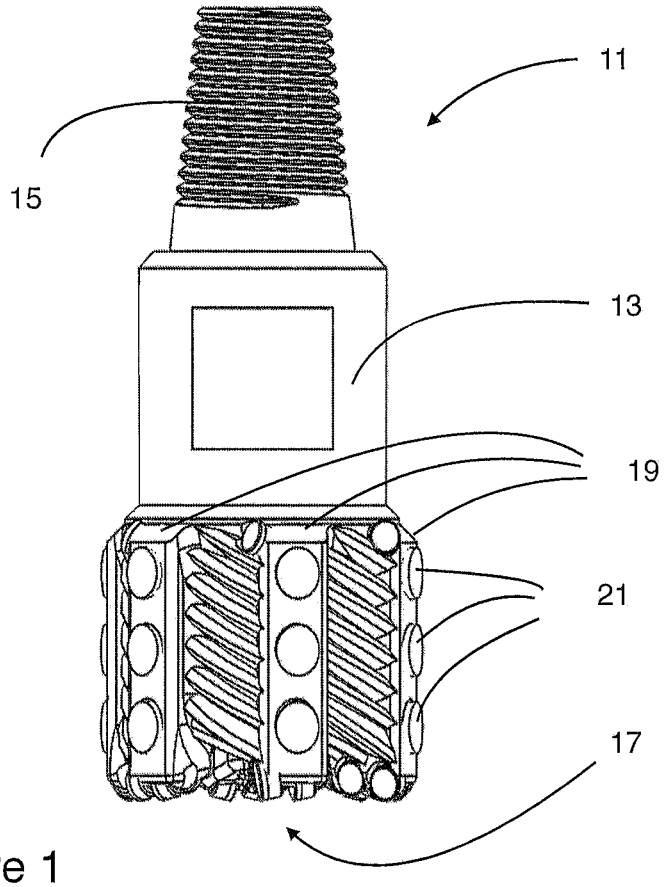
FIGS. 1 and 2 are elevation and bottom plan views of a cased-hole bit in accordance with an embodiment of the present application.

While the cased-hole bit or tool of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the cased-hole tool of this application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
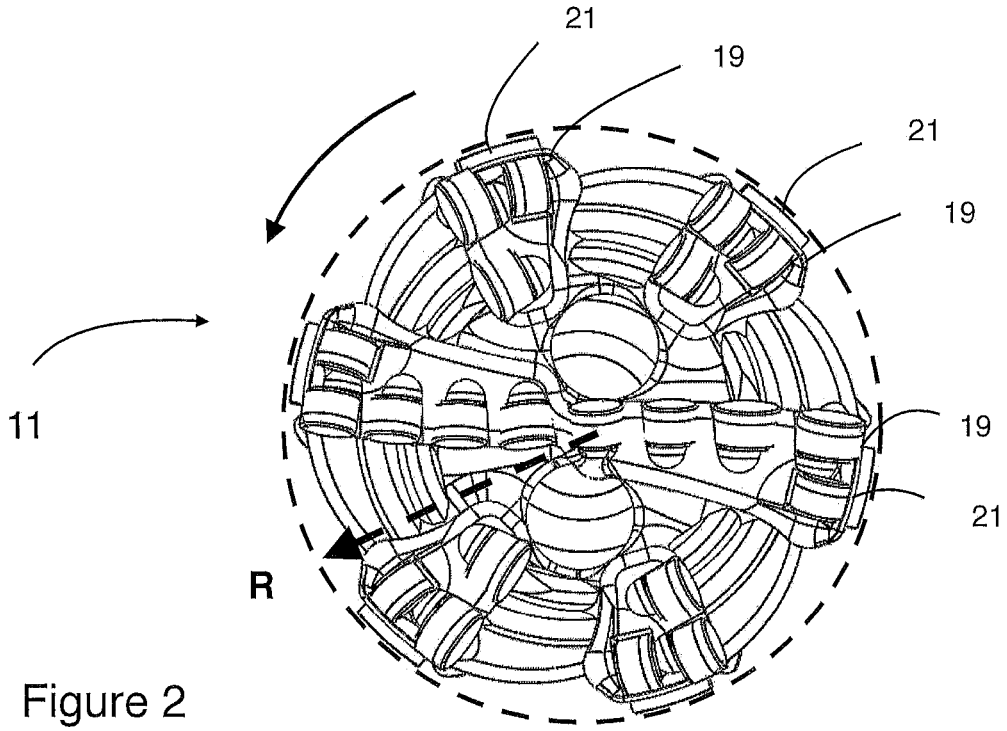

Referring to the Figures, FIGS. 1 and 2 illustrate a cased-hole bit 11 according to an exemplary embodiment of the present application. Bit 11 comprises a bit body 13, that may include a steel shank that is threaded or otherwise configured at its upper extent 15 for connection into a drill string comprising multiple sections of drill pipe, which may include a motor, or, in some cases, coiled tubing with a motor. At a lower end of bit body 13, there is a bit or cutting face 17, which may include a plurality of fixed cutters or cutting elements, as illustrated, or one, two, or three rolling cutters carrying cutting elements. Near the outermost diameter of bit 11, upward of the cutting or bit face 17, a radially outermost bit body or gage surface may be comprised of a plurality of gage pads 19, on which are mounted a plurality of gage inserts 21 that define a gage cutting structure.

As depicted in FIG. 2, gage inserts or elements 21 of the gage cutting structure extend to the full nominal diameter of bit 11 or tool (indicated by a dashed line), while gage pads 19 define a diameter several tenths or hundredths of an inch smaller than the nominal diameter of bit 11. The portion of insert or element 21 extending beyond the adjacent gage surface is referred to as the exposure of the insert or element (E in FIG. 4). Because the wellbore in which the tool rotates is cased, it will have a nominal inner diameter (ID) determined by the casing specification. For example, American Petroleum Institute (API) 5½-inch 20 lb casing will have a nominal ID of 4.778-inch and a drift of 4.653-inch, and API recommends a 4.625-inch nominal diameter drill bit or tool. For purposes of this application, the "gage diameter" defined by the outermost projection of gage inserts 21 is the nominal bit diameter, while gage pads 19 or other gage surface is about 0.100 inch less than the nominal bit diameter. Thus, the radius R of the bit 11 or tool (measured from its central, longitudinal, or rotational axis) is one-half the recommended or desired nominal diameter of bit or tool 11, which in turn is slightly smaller than the radius or diameter of the cased wellbore or hole (as measured from its center or central axis).

Bit 11 of FIGS. 1 and 2 is exemplary of a tool used in a cased wellbore to disintegrate and remove structures or equipment from the cased wellbore. Bits of other configurations, and tools such as subs located above bits or other tools may benefit from the gage cutting structure described herein and are specifically contemplated by the present application. Such bits or tools may have discrete gage pads 19, as illustrated in FIGS. 1 and 2, or may be simple, smooth-walled cylinders, or may take configurations as illustrated below in FIGS. 9 through 14. Gage inserts 21 may be mounted on any of these tools.

Figure 3:
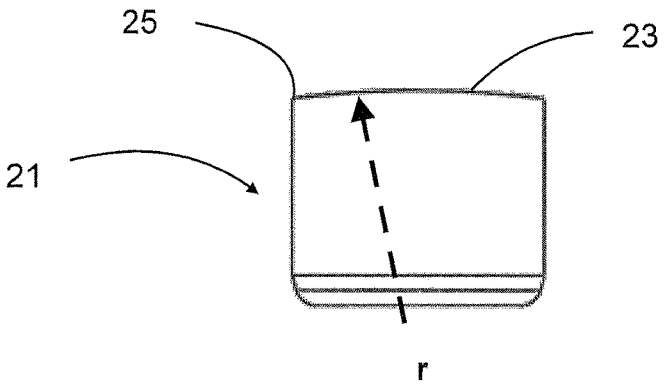
FIG. 3 is an enlarged elevation view of a gage insert or element as used in the bit illustrated in FIGS. 1 and 2.
Figure 4:
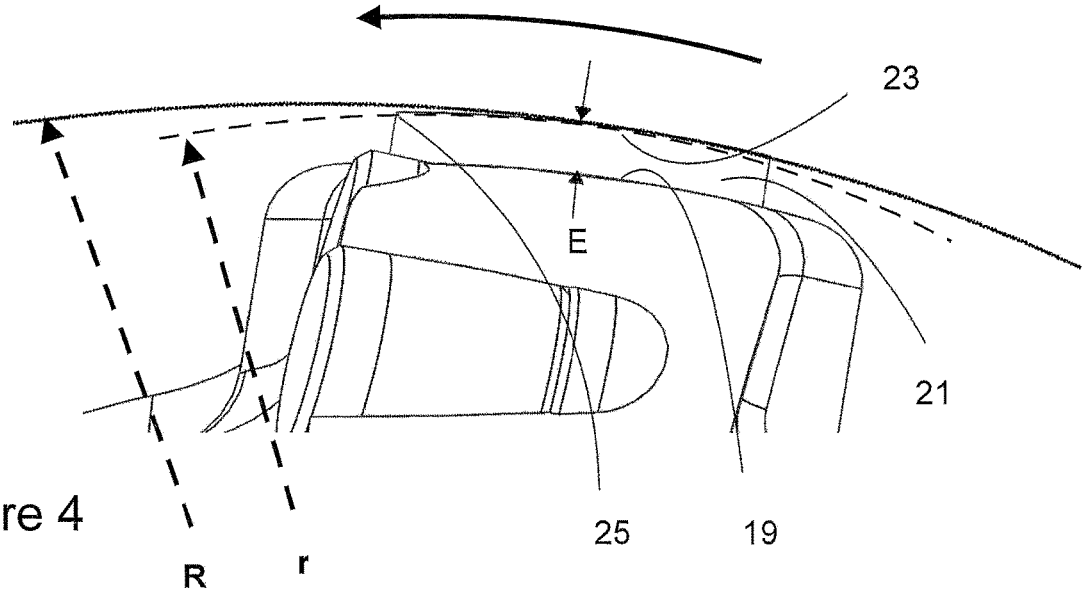
FIG. 4 is an enlarged fragmentary view of the gage insert or element of FIG. 3 in engagement with the sidewall of a cased wellbore.

FIGS. 3 and 4 illustrate a gage insert or element 21 in accordance with an embodiment of the present application. insert or element 21 may be formed of cemented tungsten carbide or any other suitable hardmetal, or may be formed at least partially of polycrystalline diamond, cubic boron nitride, or other superhard material. Inserts typically may be of a generally cylindrical configuration and are brazed (either individually or in-situ as in the case of an infiltrated matrix bit) or interference fit into apertures formed in a surface with a cutting end 23 extending from the surface. Gage insert or element 21 according to this embodiment of the present application is generally cylindrical and has a curved or arcuate cutting end 23. Arcuate cutting end 23 may be curved (circularly) in only one plane with a radius r that is less than or equal to the radius R of bit 11. The intersection of the curved cutting end surface with the cylindrical body of insert or element 21 defines a cutting edge 25.

Figure 5:
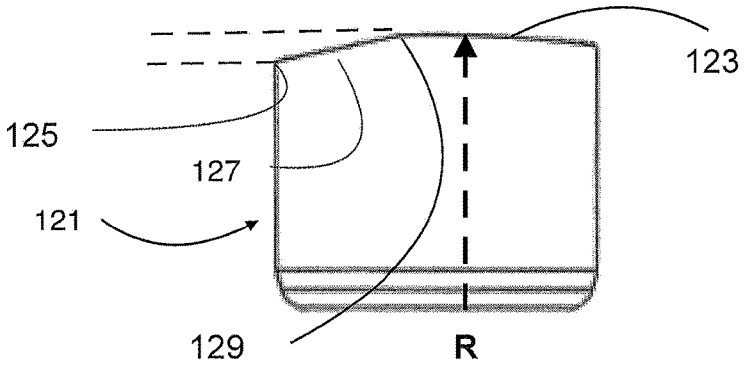
FIGS. 5 and 6 are enlarged elevation and isometric views of another embodiment of the gage insert or element in accordance with the present application.
Figure 6:
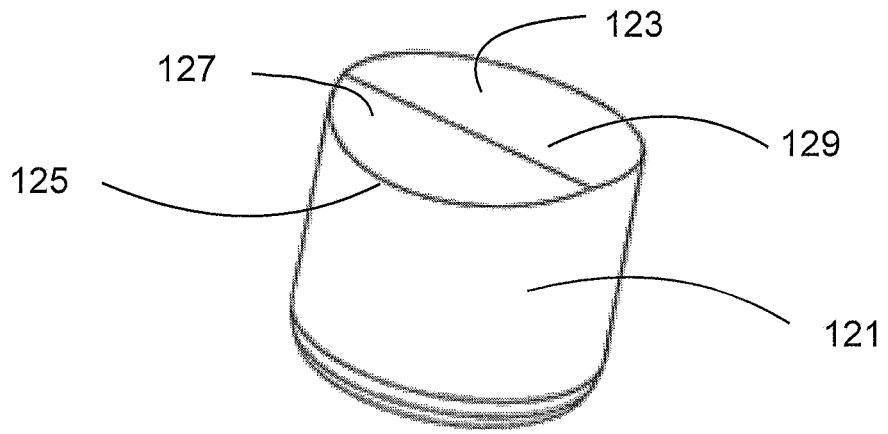

As shown in FIG. 4, when insert or element 21 is secured to gage pad 19 or other gage surface near the sidewall of the cased wellbore, it is oriented with the cutting edge 25 leading and aligned in the direction of rotation of the bit or tool (indicated by the arrow), so that the "apex" or outermost end of curved cutting end 23 (of radius r) extends into contact with the cased borehole (which is slightly larger than the radius R of the tool or bit 11, where R r) while cutting edge 25 is recessed from the sidewall of the cased borehole and thus only minimally engages and/or cuts the casing sidewall. Recessed cutting edge 25 is positioned to engage and disintegrate material passing between adjacent gage pads and inserts 19, 21, or between adjacent inserts 21, while minimizing or eliminating engagement with, cutting, or damaging the casing. A plurality of inserts 21, arranged in rows on gage pads as depicted in FIGS. 1 and 2, or other patterns on pads or other gage surfaces, form a cutting structure for cased-hole tools. While a cutting edge recessed or slightly inward of the radius R of tool or bit 11 is preferred, it is also believed that an insert or element in which the cutting edge extends to the radius R along with the outermost end or exposure of the insert, that is, where r=R, will also accomplish the objects of the present application FIGS. 5 and 6 illustrate another embodiment of a gage insert or element 121 according to the present application. Again, insert or element 121 may have a generally cylindrical body, with a flat cutting end 123. A second, inclined flat surface 127 slopes downward from the flat surface of cutting end 123 and intersects the body of insert or element 121 to define a sharp cutting edge 125. The intersection 129 of the flat surface of cutting end 123 and second, inclined flat surface 125 describes an obtuse angle that has little or no cutting function and is thus blunt. Thus, similar to the insert or element 21 of FIGS. 3 and 4, when mounted in the gage surface of a tool, cutting edge 125 is recessed or spaced inwardly from the sidewall of the cased wellbore and is prevented from engaging, cutting, or damaging the casing, by the remainder of cutting end 123 of insert or element 121, which extends to the full nominal tool or bit 11 diameter or radius (2R or R).

Figure 7:
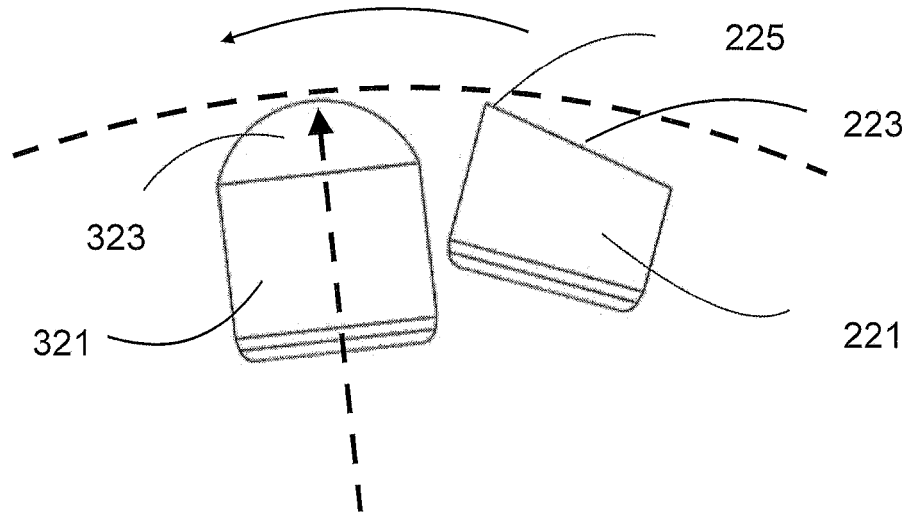
FIG. 7 is an enlarged, fragmentary view of another embodiment of gage inserts in accordance with the present application.

FIG. 7 depicts a two-insert or element embodiment of the gage cutting structure according to the present application. A first, cutting insert or element 221 has a flat-topped cutting end 223 that is inclined such that its intersection with the cylindrical body forms an acute cutting edge 225. A second insert or element 321 leads first insert or element 221 in the direction of rotation and has a completely blunt, spherical or ovoid cutting end 323 that is devoid of cutting edges. As illustrated, both inserts 221, 321 occupy the same axial location, or distance from the bit or cutting face 17, but they may be axially offset or at different axial heights so long as leading insert 321 is effective to prevent cutting engagement of trailing insert 221 with the sidewall of the wellbore. In this embodiment, the outermost projection or exposure of second or leading insert or element 321 and of cutting edge 225 of first or trailing insert or element 225 extend to the full gage diameter (2R) of the bit or tool. The circumferential or angular spacing between blunt 321 and cutting 221 inserts is such that blunt insert or element 321 prevents cutting edge 225 of cutting insert or element 221 from engaging and cutting the casing at the sidewall of the cased borehole. A similar effect may be obtained by a ridge or other buildup of surface material that extends to the gage diameter and takes the place of the leading, blunt insert or element 321 and should be considered within the scope of the invention.

Figure 8:
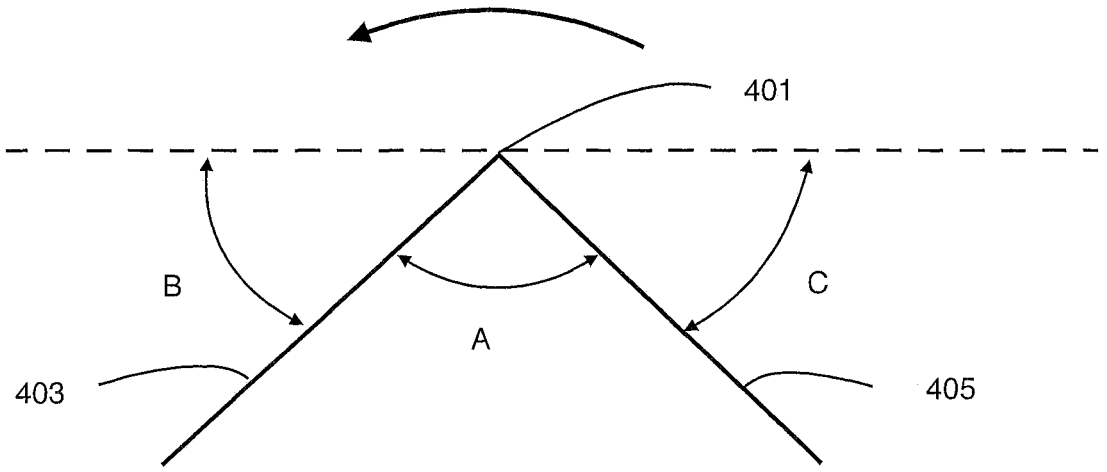
FIG. 8 is a schematic view of surfaces and angles defining a cutting edge as that term is used in the present application.

All of the foregoing embodiments of according to the present application employ gage inserts or elements that have a cutting edge that is protected from excessive engagement or cutting with the casing lining a cased borehole. FIG. 8 is a schematic view of such a cutting edge 401, defined at the intersection of a leading surface 403 and a trailing surface 405, as defined by a direction of travel or rotation indicated by the arrow. An edge included angle A is included between the two intersecting surfaces 403 and 405. A leading angle B is defined between a dashed line tangent to the point of contact between edge 401 and surface 501, and leading surface 403. A trailing angle C is defined between the same dashed tangent line and trailing surface 405.

To effectively cut, a stress must be generated at edge 401 sufficient to deform the material engaged by edge 401, in this case, the casing at the sidewall of a cased wellbore. The magnitude of that stress may be increased by reducing the area of contact, which can be achieved initially by decreasing the edge included angle A. However, even for a very narrow edge angle A, if either the leading angle B or trailing angle C approaches zero, the area of contact is enlarged and sufficient stress will not be generated to deform or cut the material with which edge 401 is engaged. Because the casing surface that the gage inserts according to the present invention engage is convex, rather than the straight dashed line shown, the available leading and trailing angles B and C are further reduced before the leading 403 and trailing 405 surfaces contact that surface and increase the area and decrease the ability of edge 401 to deform or cut the casing.

Clearly, where no intersections of surfaces define an edge (for example a rounded or curved contact surface) that surface may be regarded as blunt, or incapable of generating sufficient stress to deform or cut the casing sidewall, as in the case of leading insert 321 of FIG. 7. But even an intersection of surfaces with a very acute or sharp edge 401 with a narrow included angle A may be regarded as blunt, or incapable of generating sufficient stress to deform the casing sidewall, if one of the angles B and C between the sidewall and leading 403 or trailing 405 surfaces is small enough. The embodiments of FIGS. 3 through 7 present embodiments in which a cutting edge is capable of cutting material that is not at the distance R from the centerline or central axis of tool or bit 11 (e.g. junk between the inserts and in the annulus between the bit or tool 11 and the sidewall of the cased wellbore), but are mostly, if not entirely, incapable of deforming and cutting casing at the sidewall of the borehole because the angle between the surface trailing the edge and the sidewall is nearly zero.

Figure 9:
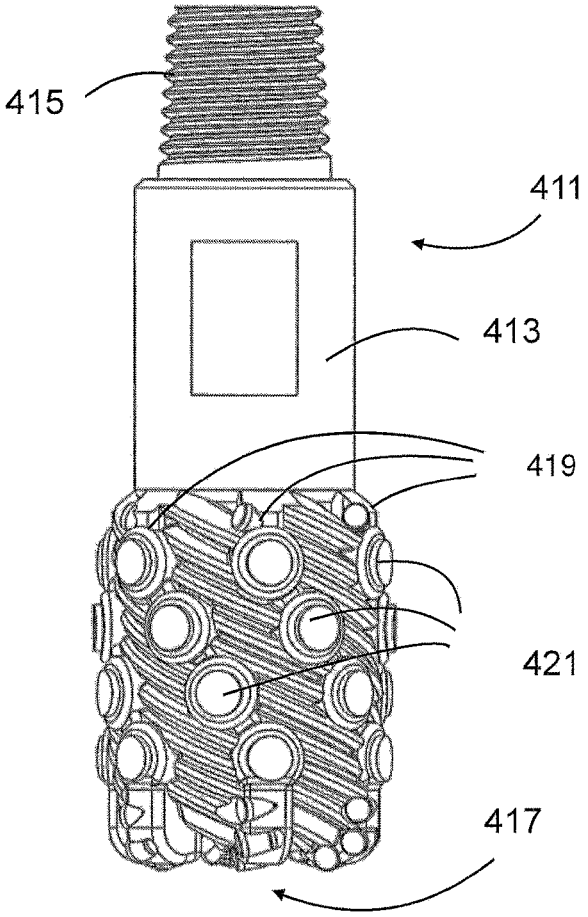
FIGS. 9, 10, and 11 are elevation, bottom plan, and perspective views of a bit or cutting tool according to an embodiment of the present application.
Figure 10:
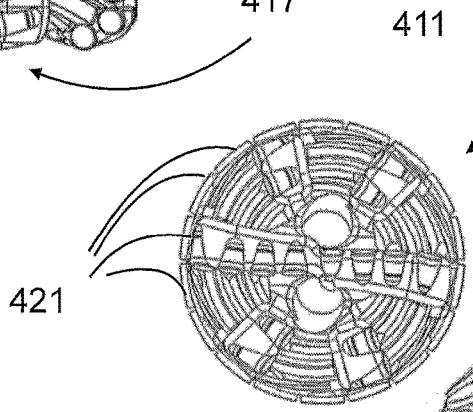
Figure 11:
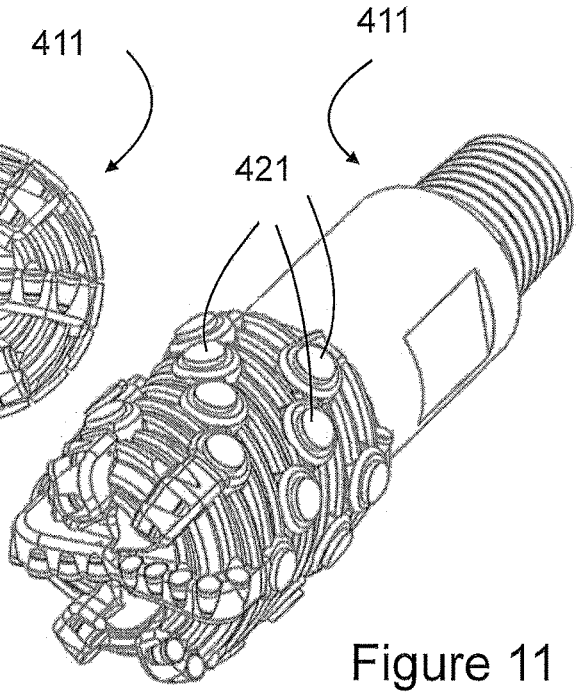

FIGS. 9, 10, and 11 depict a bit 411 similar to that illustrated in FIGS. 1 and 2, with similar or corresponding structures numbered similarly. In this embodiment, gage inserts or cutting elements 421, as described above, may be arranged in helical or spiral rows, without a discrete gage pad, only the individual bosses or surfaces 419 on which each individual insert 421 is mounted. As described in connection with FIGS. 2 though 4, inserts 421 have radially outermost, blunt or non-cutting surfaces extending to the full nominal gage diameter (2R) of the wellbore, and have cutting edges extending to a distance less (r) than full nominal gage diameter.

Figure 12:
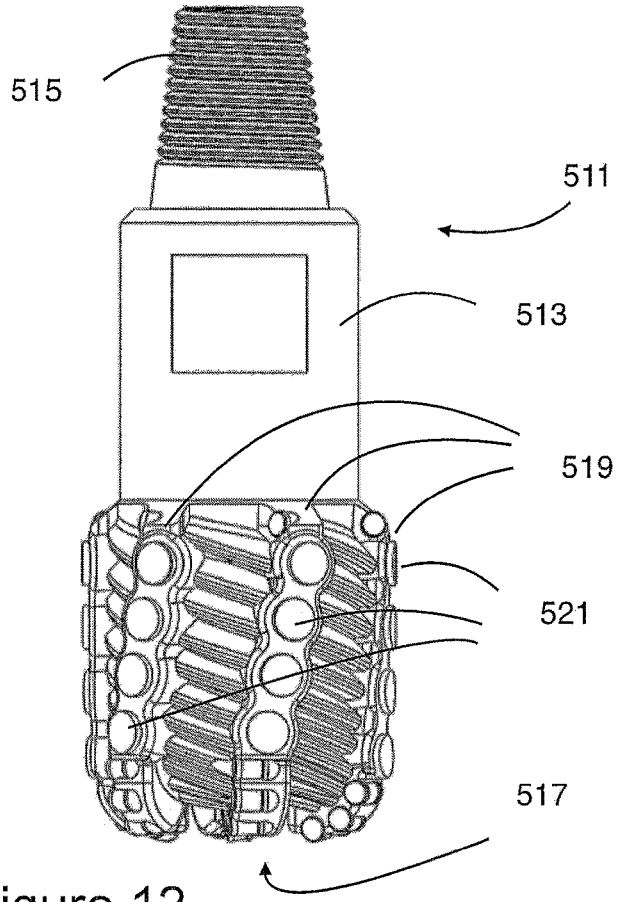
FIGS. 12, 13, and 14 are elevation, bottom plan, and perspective views of a bit or cutting tool according to another embodiment of the present application.
Figure 13:
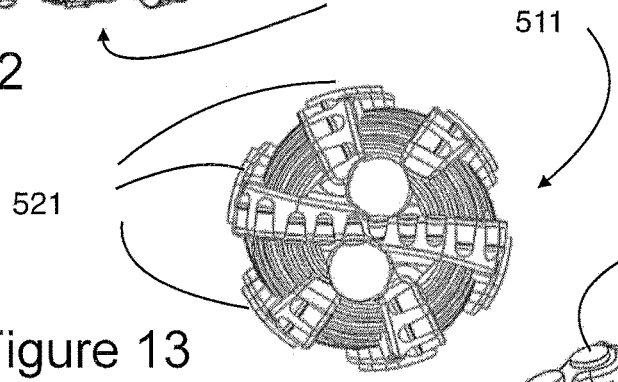
Figure 14:
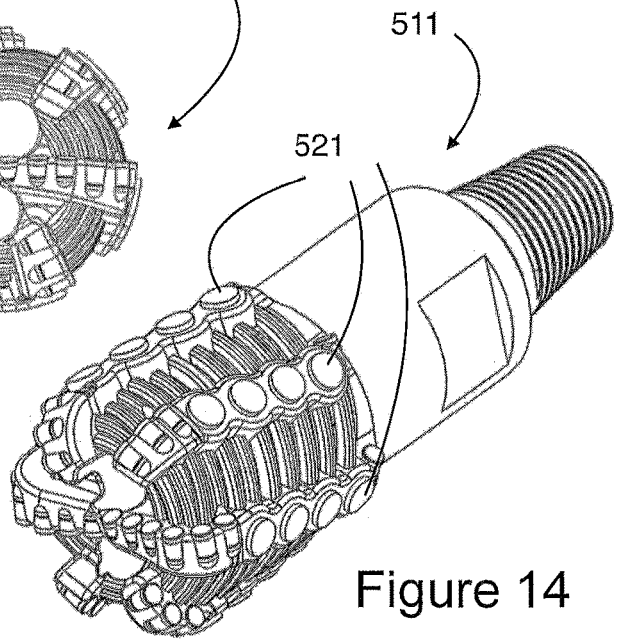

FIGS. 12, 13, and 14 illustrate a bit 511 similar to that illustrated in FIGS. 1 and 2, with similar or corresponding structures numbered similarly. In this embodiment, gage inserts or cutting elements 521, as described above, may be arranged in helical or spiral rows on a discrete gage pad 519. As described in connection with FIGS. 2 though 4, inserts 521 have radially outermost, blunt or non-cutting surfaces extending to the full nominal gage diameter (2R) of the wellbore, and have cutting edges extending to a distance less (r) than full nominal gage diameter.

In the arrangement illustrated in FIGS. 9 through 11, helical rows of inserts 421 provide dense circumferential coverage while the lack of gage pads provides a relatively free flow of fluid and cuttings up the annulus between bit body 413 and the wellbore sidewall. In the arrangement depicted in FIGS. 12 through 14, helical rows of inserts 521 on discrete gage pads 519 are at a more vertical pitch or angle such that discrete or identifiable junk slots remain defined up the annulus, providing relatively more free passage of fluid and cuttings up the annulus. It may be desirable to control or adjust the flow rate of fluid and cuttings up the annulus, either to provide faster cutting (less restricted flow) or to produce smaller cuttings (more restricted flow). Thus, greater circumferential coverage may be provided than linear or vertical rows, while avoiding blockage of flow up the annulus between the bit body and wellbore sidewall.

The inserts described above may be arranged in patterns on bits and various other tools configured for cased-hole operations to provide a cutting structure for disintegration of components or equipment in a cased hole without inflicting excessive damage on the casing in the wellbore.

It is apparent that a cased-hole tool with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

We claim:

1. A downhole tool for use in disintegrating structures in a cased wellbore, the tool comprising:

a tool body having a central axis about which the tool body rotates;

an outermost gage surface on the tool body; and at least one gage cutting element on the gage surface, the cutting element having a blunt outermost projection and a sharp cutting edge recessed from the blunt outermost projection, wherein, during rotation of the tool body, the blunt outermost surface contacts the cased wellbore and the sharp cutting edge does not;

wherein the gage cutting element is asymmetric relative to a radially axial plane passing through the central axis of the tool body; and wherein the radial distance from the central axis of the tool body to the blunt outermost projection is less than the radius of the cased wellbore, such that neither the blunt outermost projection nor the sharp cutting edge increase the diameter of the cased wellbore.

2. The downhole tool of claim 1, wherein the tool is a drill bit having an upper extent configured for connection into a drill string, a cutting face at a lower extent, and the outermost gage surface extends between the upper and lower extents.

3. The downhole tool of claim 1, wherein the gage cutting element further comprises:

a generally cylindrical body;

a cutting end extending from the generally cylindrical body;

an arcuate surface on the cutting end and defining the blunt outermost projection of the cutting element; and the cutting edge defined by an intersection of the arcuate surface and the cylindrical body, the cutting edge being recessed relative to the arcuate surface.

4. The downhole tool of claim 1, wherein the gage cutting element further comprises:

a generally cylindrical body;

a cutting end extending from the generally cylindrical body;

a pair of flat surfaces on the cutting end, the flat surfaces intersecting each other to define the blunt outermost projection; and the cutting edge defined by the intersection of one of the flat surfaces with the cylindrical body, the cutting edge being recessed relative to the intersection of the flat surfaces.

5. The downhole tool of claim 1, wherein the cutting edge is a leading surface of the gage cutting element in a direction of rotation of the tool.

6. The downhole tool of claim 1, wherein the gage cutting elements are secured to pads on the gage surface.

7. A downhole tool for use in disintegrating structures in a cased wellbore, the tool comprising:

a tool body having a central axis about which the tool body rotates;

an outermost gage surface on the tool body;

a gage cutting insert configured for insertion into the gage surface, the gage cutting insert comprising:

a first surface forming a blunt element, leading in a direction of rotation of the downhole tool and having a non-cutting radially outermost surface; and a second surface forming a cutting element having a sharp cutting edge, wherein the cutting element does not cut the cased wellbore;

wherein the blunt element and the cutting element are disposed on a single radially exterior portion of the gage cutting insert.

8. The downhole tool of claim 7, wherein the tool is a drill bit having an upper extent configured for connection into a drill string, a cutting face at a lower extent, and the outermost gage surface extends between the upper and lower extents.

9. The downhole tool of claim 7, wherein the cutting edge is a leading surface of the gage cutting element in a direction of rotation of the tool.

10. A gage cutting element for use on a radially outermost surface of a downhole tool operable in a cased wellbore having a radius, the gage cutting element comprising:

a generally cylindrical body;

a cutting end extending from the generally cylindrical body;

an arcuate surface on the cutting end and defining a blunt outermost projection of the cutting element; and a cutting edge defined by an intersection of the arcuate surface and the cylindrical body, the cutting edge being radially recessed relative to the outermost projection of the arcuate surface;

wherein the radial distance from a central axis of the downhole tool to the blunt outermost projection is less than the radius of the cased wellbore, such that the cutting end, the blunt outermost projection, and the cutting edge do not increase the diameter of the cased wellbore; and wherein the gage cutting element is asymmetric relative to a radially axial plane passing through the central axis of the downhole tool.

11. The gage cutting element of claim 10, wherein at least the cutting edge is formed of a superhard material.

12. A gage cutting element for use on a radially outermost surface of a downhole tool operable in a cased wellbore, the asymmetric gage cutting element comprising:

a generally cylindrical body;

a cutting end extending from the generally cylindrical body;

a pair of flat surfaces on the cutting end, the flat surfaces intersecting each other to define a blunt outermost projection; and a cutting edge defined by the intersection of one of the flat surfaces with the cylindrical body, the cutting edge being radially recessed relative to the blunt outermost projection;

wherein the gage cutting element is asymmetric relative to a radially axial plane passing through a central axis of the downhole tool.

13. The asymmetric gage cutting element of claim 12, wherein the cutting edge is a leading surface of the cutting element in a direction of rotation of the downhole tool.

14. The asymmetric gage cutting element of claim 12, wherein at least the cutting edge is formed of a superhard material.

15. An earth-boring bit for use in disintegrating structures in a cased wellbore, the earth-boring bit comprising:

a bit body having a central axis about which the earth-boring bit rotates;

an outermost gage surface on the bit body; and at least one gage cutting element on the gage surface, the cutting element having a blunt outermost projection and a sharp cutting edge recessed from the blunt outermost projection, wherein, during rotation of the bit body, the blunt outermost surface contacts the cased wellbore and the sharp cutting edge does not;

wherein the gage cutting element is asymmetric relative to a radially axial plane passing through the central axis of the bit body; and wherein the radial distance from the central axis of the bit body to the blunt outermost projection is less than the radius of the cased wellbore, such that neither the blunt outermost projection nor the sharp cutting edge increase the diameter of the cased wellbore.

16. The earth-boring bit of claim 15, wherein the gage cutting element further comprises:

a generally cylindrical body;

a cutting end extending from the generally cylindrical body;

an arcuate surface on the cutting end and defining the blunt outermost projection of the cutting element; and the cutting edge defined by an intersection of the arcuate surface and the cylindrical body, the cutting edge being recessed relative to the arcuate surface.

17. The earth-boring bit of claim 15, wherein the gage cutting element further comprises:

a generally cylindrical body;

a cutting end extending from the generally cylindrical body;

a pair of flat surfaces on the cutting end, the flat surfaces intersecting each other to define the blunt outermost projection; and the cutting edge defined by the intersection of one of the flat surfaces with the cylindrical body, the cutting edge being recessed relative to the intersection of the flat surfaces.

18. The earth-boring bit of claim 15, wherein the sharp cutting edge is a leading surface of the gage cutting element in a direction of rotation of the bit.

19. The earth-boring bit of claim 15, wherein the gage cutting elements are secured to pads on the gage surface.

* * * * *